United States Patent [19]

Ladriere

[11] Patent Number: 4,827,650

[45] Date of Patent: May 9, 1989

[54] FIREARMS INTENDED TO FIRE A CASELESS PROJECTILE, AND AMMUNITION OF THIS KIND ADAPTED FOR SUCH WEAPONS

[76] Inventor: Serge Ladriere, "Le Cottage" 27, Boulevard du Plan des Abeilles, 06230 Saint Jean Cap Ferrat, France

[21] Appl. No.: 140,206

[22] Filed: Dec. 31, 1987

[30] Foreign Application Priority Data

Jan. 19, 1987 [FR] France ..... 87 00511

[51] Int. Cl.[4] ..... F41C 21/12; F41F 17/02

[52] U.S. Cl. ..... 42/76.01; 89/14.05; 102/374; 102/431; 102/439

[58] Field of Search ..... 42/76.01; 89/1.3, 14.05; 102/431, 432, 433, 439, 374

[56] References Cited

U.S. PATENT DOCUMENTS 4,000,697 1/1977 Levine .
4,686,905 8/1987 Szabo ..... 42/76.01
4,782,758 11/1988 Washburn ..... 102/439

FOREIGN PATENT DOCUMENTS 79338 1/1934 Sweden ..... 102/439

*Primary Examiner*—Charles T. Jordan
*Assistant Examiner*—Richard W. Wendtland
*Attorney, Agent, or Firm*—Larson and Taylor

[57] ABSTRACT

The disclosed weapon system comprises a gun barrel and a cooperating caseless ammunition. The ammunition is temporarily retained within the gun barrel by means of a conical force fit. The coupling comprises a female conical surface in the rear of the gun barrel and a male conical surface on the rear of the projectile wherein both surfaces have the same conicity.

24 Claims, 4 Drawing Sheets

Figures 1, 2, 3, 4:
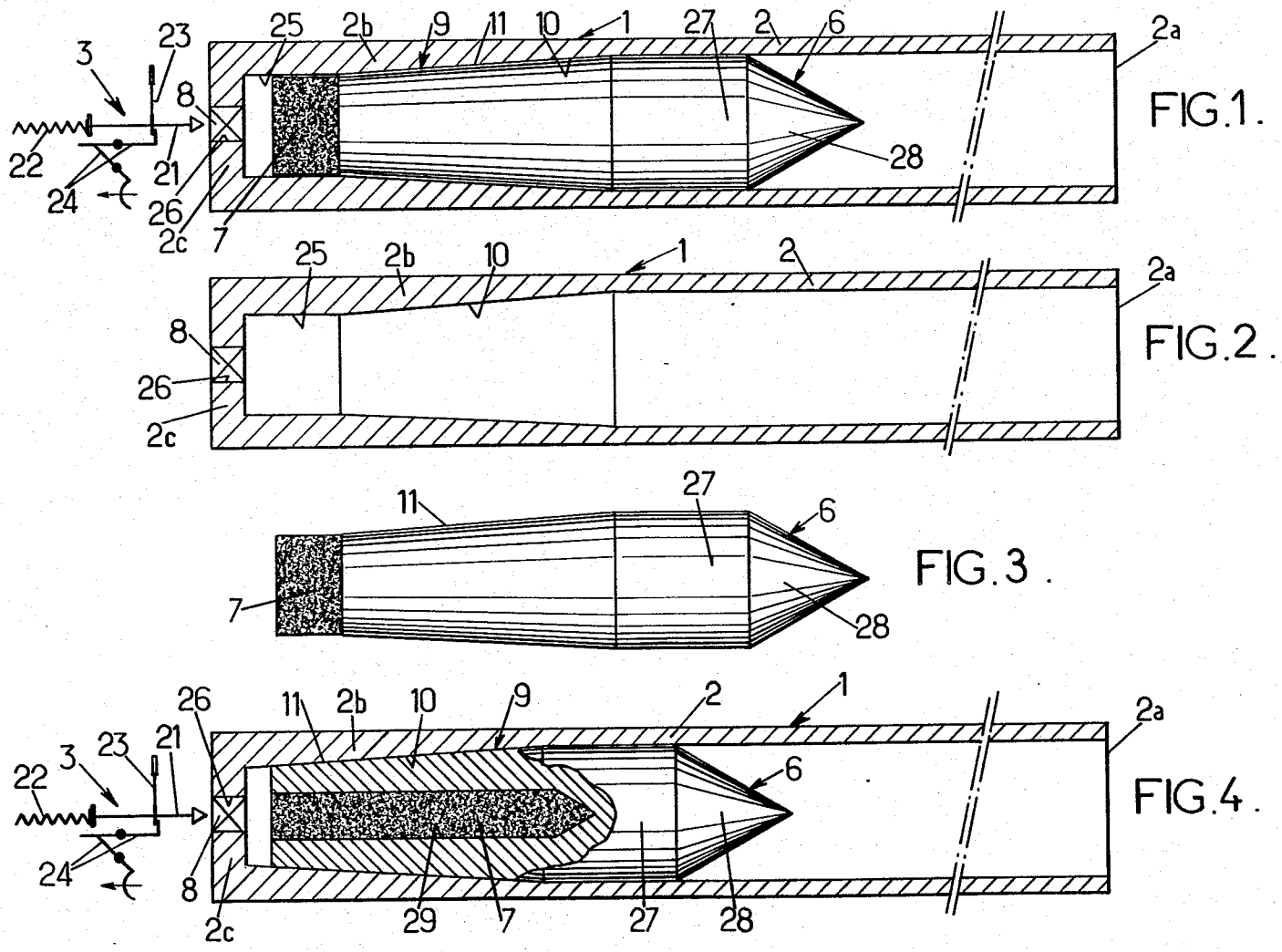

1
2
2a
2b
2c
3
6
7
8
9
10
11
21
22
23
24
25
26
27
28
29

FIREARMS INTENDED TO FIRE A CASELESS PROJECTILE, AND AMMUNITION OF THIS KIND ADAPTED FOR SUCH WEAPONS

The invention is relative to firearms intended to fire a caseless projectile and to ammunition of this kind adapted for such weapons.

By the expression "firearm" is designated a weapon having at least one tube through which a projectile is fired and a device for triggering this firing.

The tube to which reference is made forms the part of the weapon in which the ammunition is fired. Thus, the tube may form the whole barrel of the weapon or solely the rear part of this barrel; in this latter case the weapon may comprise a mechanism with several tubes (of the cylinder kind) capable of passing in front of a barrel.

Concerning "caseless ammunition", it will be recalled first of all that conventional ammunition "with case" is formed essentially of a projectile, a case housing a powder charge, a priming device carried by this case, and a securing means between the projectile and the case (securing means generally formed by crimping the case on the projectile).

Such ammunition "with case" has a certain number of drawbacks formed by their cost price (the case counts for 35% of the total cost price) and by the need to remove the case from the weapon once firing has been effected. Thus, a "caseless" ammunition has been sought which is essentially formed by a projectile and a powder charge joined together so as to form a single piece assembly which can be handled and stored, priming means being provided for firing said powder charge.

Such "caseless" ammunition is then of a lower cost price then ammunition "with case" and, of course, the absence of a case resolves the problem of removal.

However, the ballistic characteristics inside the tube of the weapon, are quite different when firing ammunition "with case" and when firing "caseless" ammunition, this difference resulting in a considerable drawback affecting the firing of "caseless" ammunition.

In fact, when firing ammunition "with case", the temporary securing means between the projectile and its case are active until the pressure in the case, after triggering of the priming device and combustion of the powder charge, reaches a value PC corresponding to the force to be exerted on the projectile for breaking the temporary securing means, separating it from the case and propelling it in the tube of the weapon. Depending on the caliber of the projectile, its weight, the construction of the tube of the weapon (smooth bore tube or rifled bore tube) an optimum value of this pressure PC is determined as a function of the temporary securing means (generally crimping of the case on the projectile) which it is possible to use.

On the contrary, during firing of "caseless" ammunition of known type, nothing opposes the propulsion in the tube of the weapon, except the inertia of the projectile and possible cooperation between the projectile and the bore of the tube. Thus, in this case, quite different ballistic characteristics are obtained inside the tube of the weapon because the propulsion of the projectile in the tube of the weapon begins as soon as the pressure caused by the combustion of the powder charge reaches a value PO which, for equal caliber and weight of the projectile, and for identical type of tube, is less than the pressure PC recorded in the case of firing ammunition "with case", which leads to a lower propulsion efficiency.

Thus, it may be indicated that in the case of firing ammunition "with case" housing 0.40 g of powder, of a caliber of 9 mn and a weight of 9 g, in a tube rifled to the pitch of 250 mm, the pressure $P_C$ is about 1800 bars for a case-projectile fastening provided by crimping at 50 kg.

The performances of the projectile at the outlet of the tube will be:

linear speed = 370 m/s speed of rotation = 88 000 rpm.

In the case of firing "caseless" ammunition of known type, in order to obtain satisfactory characteristics and performances, the inertia of the projectile and the possible cooperation between the projectile and the bore of the tube must be adjusted.

The present invention relates then to a weapon intended to fire "caseless" ammunition and the ammunition adapted for this weapon.

The purpose of the present invention is to make this weapon and its adapted ammunition such that the characteristics and performances are even better than those recorded in the base of ammunition "with case", while benefitting from the advantages inherent in "caseless" ammunition.

In accordance with the invention, the weapon intended to fire "caseless" ammunition formed of a projectile with a powder charge, comprises at least one tube with an open end and a bottom, opposite said open end, and a fire triggering device adapted for causing firing of the powder charge through priming means and it is characterized by the fact that said bottom is equipped with temporary retention means cooperating with said projectile, these temporary retention means being adapted so as to cease being active as soon as the pressure developed in the bottom of the tube reaches a value $P_M$ which may be optimized as a function of the caliber of the projectile, of the weight of the projectile, of the construction of the weapon (smooth bore tube or rifled bore tube) and also of the nature of the desired firing (short, medium or long range firing), such optimization being made possible by appropriately determining the temporary retention means.

In a preferred embodiment of the invention, these temporary retention means are formed by a conical force fit and connection having, at the level of the bottom of the tube a female conical surface and, at the level of the rear part of the projectile, a male conical surface, these two male and female conical surfaces having the same conicity.

Advantageously, this conicity is between 2% and 6% and the axial extent of these two conical surfaces is between 0.5 times and four times the caliber of the projectile.

It will then be possible, by adjusting the conicity and the axial extent of the male and female conical surfaces, and by applying a given fitting force, to provide temporary retention means which cease to be active (that is to say able to be released) by a given force corresponding to an optimum value of the pressure $P_M$).

In accordance with the invention, the ammunition is formed of a projectile provided with a powder charge and it is characterized by the fact that its rear part comprises a male conical surface.

Advantageously, the conicity of this male conical surface is between 2% and 6% and its axial extent is between 0.5 times and 4 times the caliber of the projectile.

With the invention, firing may be obtained with much better performances than in the case of firing with ammunition "with case" and with the advantages inherent in "caseless" ammunition.

Thus, in the case of "caseless" ammunition in accordance with the invention, having 0.40 g of powder, of a caliber of 9 mm, the weight of the projectile being 9 g, and the rifling of the tube being to the ptich of 250 mm, the pressure $P_M$ will be about 2300 bars for temporary retention means producing a retention effect of 300 kg.

In this case, the performances of the projectile on leaving the tube will be:

linear speed=490 m/s, rotational speed=117 600 rpm.

the invention makes it possible to construct numerous types of weapons insofar as the construction of the tube is concerned:

smooth tube weapons and smooth projectile, rifled tube weapons and smooth projectile rifled tube weapons and rifled projectile.

The invention also makes it possible to construct numerous types of weapons in so far as the construction of their ammunition supply system is concerned:

single shot weapons, repetition weapons (cylinder weapons, multiple tube weapons), weapons with loader, semiautomatic weapons (firing shot by shot), or automatic weapons (controlled or continuous burst firing).

The invention also makes it possible to construct weapons having one or more precharged tubes replaceable after firing: when it is a question of a weapon with several tubes, they may be arranged in the form of a cylinder.

In the case of a weapon with disposable tube or tubes, they may be made from a plastic material: the projectile, may, advantageously, in this latter case, have a metal material lining reinforcing the resistance of the tube at least at the level of the temporary retention means.

The invention consists, apart from the different arrangements already discussed, of certain other arrangements which are preferably used at the same time and which will be described in greater detail hereafter.

The invention may in any case be well understood from the complement of description which follows and from the accompanying drawings, which complement and drawings are relative to preferred embodiments of the invention and of course comprise no limitative character.

Figure 5:
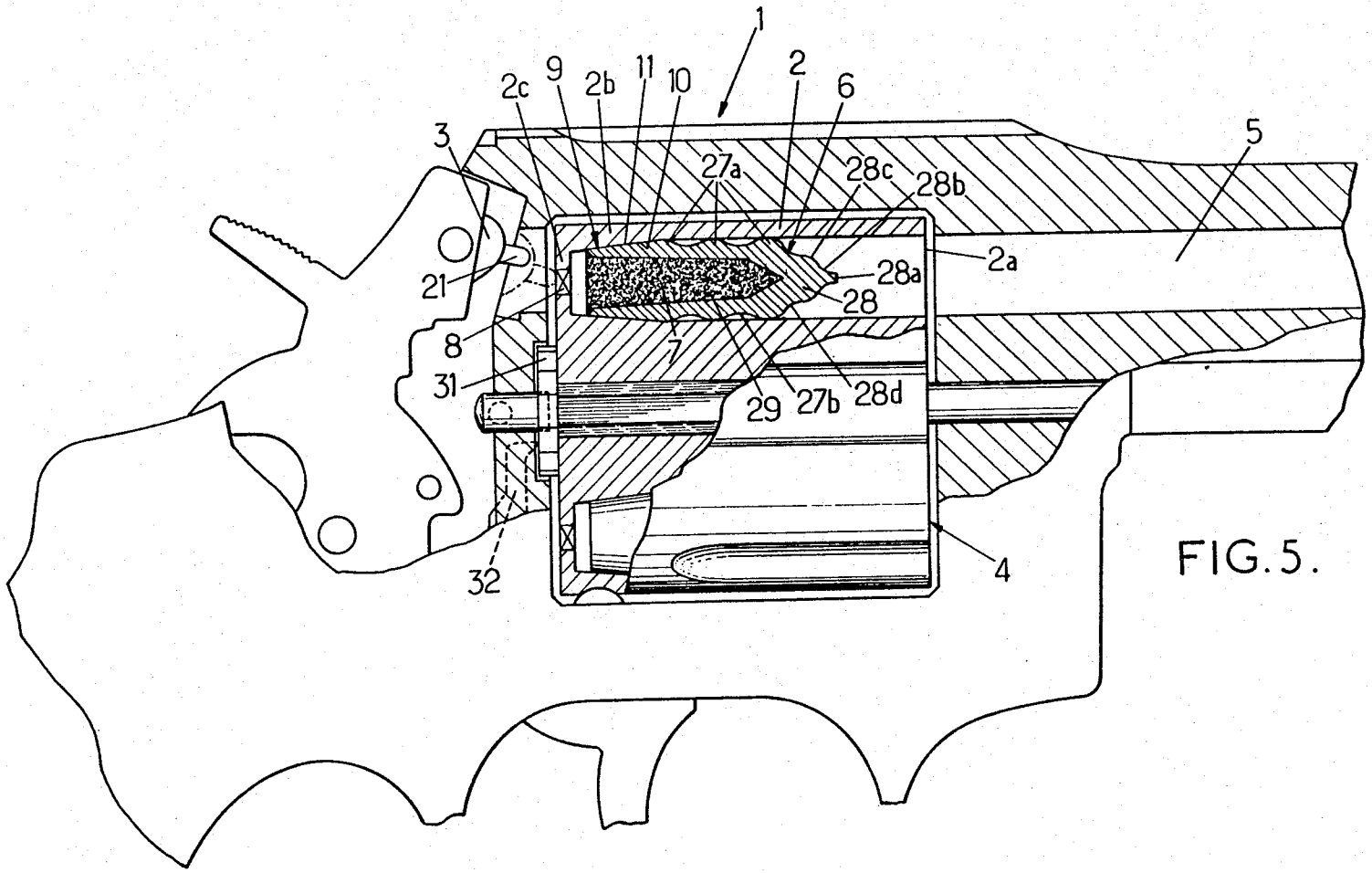
Figure 6:
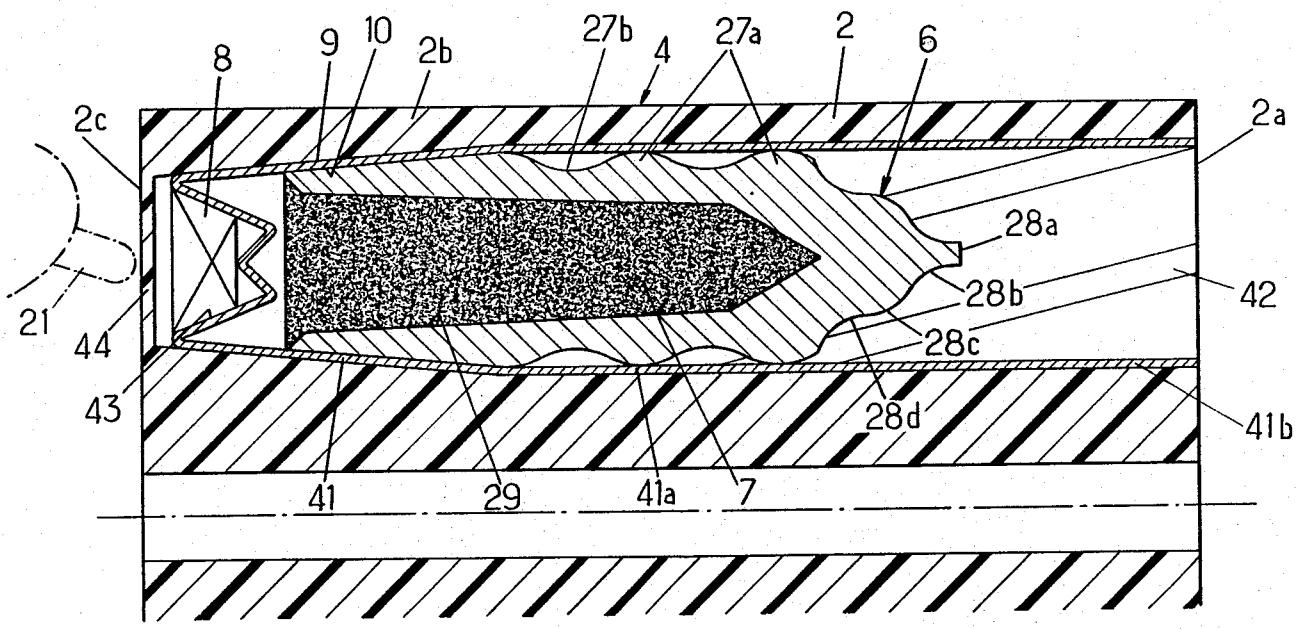
Figure 7:
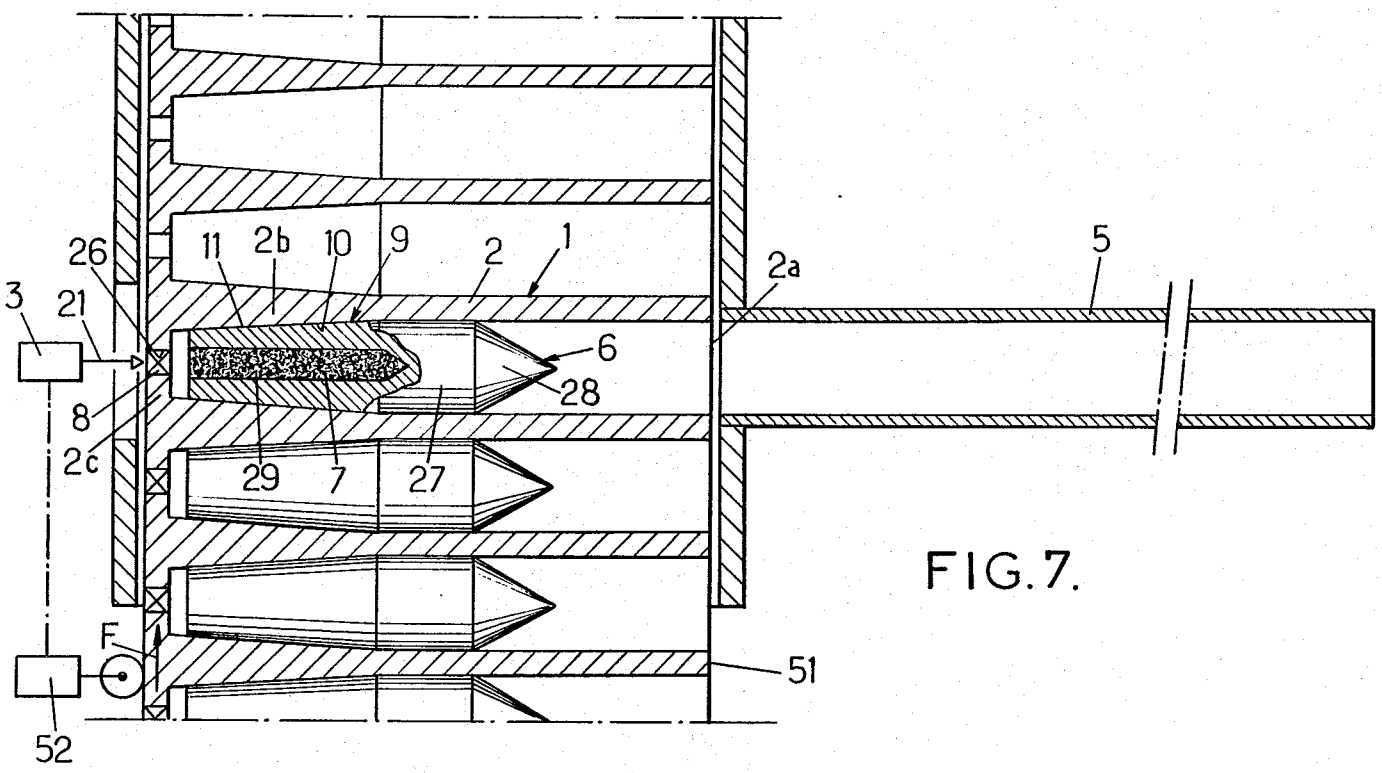

FIG. 1 is a schematical sectional view of a weapon formed in accordance with the invention and ready to fire the adapted "caseless" ammunition, FIG. 2 shows the same weapon, without adapted ammunition, FIG. 3 shows, alone, the ammunition adapted for the weapon shown in FIG. 1, FIG. 4 is a schematical sectional view of a variant of the weapon shown in FIG. 1 loaded with its adapted "caseless" ammunition, FIG. 5 is a schematical sectional view of a cylinder weapon constructed in accordance with the invention and ready to fire the adapted "caseless" ammunition, FIG. 6 shows in section and on a larger scale, the cylinder of a weapon in accordance with the invention, this cylinder being fitted with adapted "caseless" ammunition formed in accordance with a variant of the invention, FIG. 7 is a schematical sectional view of an automatic weapon constructed in accordance with the invention.

The weapon system of the invention, formed by a new firearm intended to fire "caseless" ammunition, and by new ammunition of this type adapted for such a weapon, will be described hereafter from particular examples shown in FIGS. 1 to 7.

The weapon itself 1 has then at least one tube 2 through which a projectile is fired and a device for triggering this firing, designated generally by the reference number 3.

As was mentioned above, tube 2 of the weapon is the part of the weapon in which the ammunition is fired.

Tube 2 may then form the whole barrel of the weapon (as shown in FIGS. 1, 2 and 4).

Tube 2 may also form solely the rear part of the barrel of the weapon, and in this case the weapon may comprise a mechanism 4 with several tubes 2 of the cylinder kind capable of travelling past a barrel 5 as shown in FIGS. 5 and 6).

The "caseless" ammunition in itself is essentially formed by a projectile 6 with a powder charge 7 joined together so as to form a single piece assembly which can be handled and stored, priming means 8 being provided for firing said powder change 7.

In accordance with the invention, the weapon is intended to fire "caseless" ammunition formed by a projectile 6 provided with a powder charge 7, said weapon having a tube 2 with an open end 2*a* and a bottom 2*b*, opposite said open end 2*a*, and a device 3 for triggering the firing, adapted to cause firing of the powder charge 7 through priming means 8.

The bottom 2*b* of tube 2 is equipped with temporary retention means 9 cooperating with the projectile 6 these temporary retention means 9 being adapted so as to cease being active as soon as the pressure developed in the bottom 2*b* of tube 2 reaches a value $P_M$ which may be optimized as a function of the caliber of the projectile, of the weight of the projectile 6, of the construction of the tube of the weapon (smooth bore tube or rifled bore tube) and also of the nature of the desired firing (short, medium or long range firing), this optimization being made possible by an appropriate determination of the temporary retention means.

In a preferred embodiment of the invention, these temporary retention means 9 are formed by a conical force fit connection comprising, at the level of the bottom 2*b* of tube 2, a female conical surface 10 and, at the level of the rear part of projectile 6, a male conical surface 11, these two male 11 and female 10 conical surfaces having the same conicity.

Advantageously, this conicity is between 2% and 6% and the axial extent of these two conical surfaces is between 0.5 times and 4 times the caliber of projectile 6.

It will then be possible, by adjusting the conicity and the axial extent of the male 11 and female 10 conical surfaces, and by applying a given fitting force, to provide temporary retention means 9 ceasing to be active (i.e. being able to be released) by a given force corresponding to an optimum value of the pressure $P_M$, and this independently of all the other characteristics of the weapon and of the ammunition fired.

The weapon 1 shown in FIGS. 1 and 2 includes a tube 2 forming the whole barrel of the weapon.

The fire triggering device 3 may be formed conventionally and comprise a striker 21 disposed so as to strike the priming means 8 provided for firing the powder charge 7 of the "caseless" ammunition intended to be fired, a striker spring 22, an arming lever 23, a lever mechanism 24 adapted for retaining the striker 21 in its cocked position and releasing striker 21 so as to let it strike the priming means 8.

The bottom **2*b* of tube 2 includes the female conical surface 10 forming a part of the temporary retention means 9, and a bore 25 connecting this female conical surface 10 to the closed end 2*c* of tube 2. A housing 26 is provided in this closed end 2*c* for housing the priming means 8**.

The "caseless" ammunition adapted for this weapon and shown in FIGS. 1 and 3 is essentially formed by the projectile 6 properly speaking with its powder charge 7.

The rear part of projectile 6 includes the male conical surface 11 forming another part of the temporary retention means 9; in the extension of this male conical surface 11, projectile 6 has a cylindrical central part 27 for guiding the projectile 6 in tube 2 and a front part 28.

In FIG. 4, in which the same reference figures designate the same elements as in FIGS. 1 to 3, a weapon-"caseless" ammunition assembly is shown in which:

the female conical surface 10 forming a part of the temporary retention means 9 is extended as far as the closed end **2*c* of tube 2, the powder charge 7 of the "caseless" ammunition is housed in a housing 29 formed in the projectile 6**.

The weapon 1 shown in FIG. 5 includes a plurality of tubes 2, disposed in a cylinder 4, a tooth 31 and pawl 32 mechanism actuated by the fire triggering device 3, being provided for causing the tubes 2 of cylinder 4 to pass in front of the barrel 5 of the weapon. We find in this weapon different elements already described above, particularly striker 21 of the fire triggering device 3.

In each of tubes 2 of this cylinder 4, the arrangements of the invention are applied and the same reference figures designate the same elements as in the preceding Figures.

The cylindrical central part 27 of projectile 6 may advantageously include at least two zones in relief **27*a* separated by a hollow zone 27*b* so as to improve guidance of the projectile in tube 2 and then in barrel 5**.

The front part 28 of the projectile 6 may advantageously comprise, between its front tip **28*a* and the cylindrical central part 27, a front hollow zone 28*b*, a bulging zone 28*c* and a rear hollow zone 28*d***.

In FIG. 6, a cylinder 4 is shown having a plurality of tube 2 in each of which the arrangements of the invention are applied, the same reference figures designating the same elements as in the preceding Figures. In accordance with the complementary arrangement shown in this Figure, a metal material lining 41 is interposed between projectile 6 and tube 2, at least at the level of the temporary retention means 9.

This lining 41 may also extend forwardly at **41*a* so as to be interposed between the cylindrical central part 27 of projectile 6 and tube 2**.

Lining 41 may moreover extend forwardly at 41b, beyond the cylindrical part 27 of projectile 6, so as to form a lining for tube 2; in this case, the inner surface of parts **41*a* and 41*b* of lining 41 may include rifling 42**.

Towards the rear, lining 41 may have a housing 43 in which the priming means 8 are placed.

The closed end **2*c* of tube 2 may then be continuous and arranged in the form of a thin wall 44 so that striker 21 may strike the priming means 8 through said thin wall 44**.

It will be noted in this case that the part of the "caseless" ammunition which may be sensitive to humidity (powder charge 7 and priming means 8) is totally isolated from the ambient environment by the thin wall 44 and the conical coupling forming the temporary retention means 9.

This construction of a cylinder weapon may be obtained by using a plastic material cylinder which is replacable, even disposable, after firing "caseless" ammunition housed in its tubes.

In FIG. 7, in which the same reference figures designate the same elements as in FIG. 4, a weapon-"caseless" ammunition assembly is shown in which the weapon includes a plurality of tubes 2 disposed in a longitudinal element 51 (forming loader or belt), an advance mechanism 52, slaved to the fire triggering device 3, being provided for causing the tubes 2 of the longitudinal element 51 to pass in the direction indicated by arrow F in front of the barrel 5 of the weapon. We find again in this weapon different members already described, particularly the striker 21 of the fire triggering device 3.

In the tubes 2 of this longitudinal element 51, the arrangements of the invention are applied and the same reference figures designate the same members as in the preceding Figures.

If the longitudinal element 51 is made in the form of a loader, it may be made from a rigid material.

If the longitudinal element 51 is made in the form of a belt, it may be formed from a flexible material or material assembly.

From the description of the invention which has just been made, the multiplicity of its applications can be seen and the large number of types of weapons which it is possible to form:

one or twin shot hunting weapons (single barrel, juxtaposed barrels, superimposed barrels), single shot or repetition shoulder weapon (hunting rifle, shooting rifle, precision rifle), hand held single shot or repetition weapon, with single barrel, multiple barrels cylinder or loader, small or medium caliber automatic weapon (5.5 mm to 40 mm), medium or large caliber weapon (30 mm to 155 mm), mortars.

As is evident and as it follows moreover already from what has gone before, the invention is in no wise limited to those of its modes of application and embodiments which have been more explicitly considered, it embraces, on the contrary, all variants thereof.

I claim:

1. A weapon system comprising a weapon and a cooperating caseless ammunition formed of a projectile with a powder charge, said weapon comprising at least one tube with an open end a a bottom opposite to said open end, and a fire triggering device adapted for causing firing of said powder charge through a priming means, said bottom of said tube being equipped with temporary retention means cooperating with said projectile, said temporary retention means being adapted so as to cease being active as soon as the pressure developed in the bottom of the tube reaches a value $P_M$, said temporary retention means being formed by a conical force fit coupling comprising a female conical surface provided in the bottom of the tube and a male conical surface provided on a rear part of the projectile, these two male and female conical surfaces having the same conicity.

2. A weapon system according to claim 1, wherein the conicity of said conical coupling is between 2% and 6%.

3. A weapon system according to claim 1, wherein the axial extent of said male and female conical surfaces is between 0.5 times and 4 times and the caliber of the projectile.

4. A weapon system according to claim 1, wherein the tube is smooth and the projectile is smooth.

5. A weapon system according to claim 1, wherein the tube is rifled and the projectile is smooth.

6. A weapon system according to claim 1, wherein the tube is rifled and the projectile is rifled, the rifling formed in said tube and on said projectile corresponding with each other in so far as their shape and pitch are concerned.

7. A weapon system according to claim 1, comprising one or more preloaded tubes replacable after firing.

8. A weapon system according to claim 7, wherein said preloaded tube or tubes are made from a plastic material.

9. A weapon system according to claim 1, wherein a metal material lining is provided interposed between the projectile and the tube at least at the level of the temporary retention means.

10. A weapon system according to claim 9, wherein the lining has a front extension.

11. A weapon system according to claim 10, wherein the inner surface of the front extension includes rifling.

12. A weapon system according to claim 9, wherein the lining has, at the rear, a housing housing the priming means.

13. A weapon system according to claim 1, comprising a plurality of tubes disposed in a mobile element and a barrel, a mechanism being provided for causing the tubes of said mobile element to pass in front of the barrel.

14. A caseless ammunition formed of a projectile having a male conical surface on a rear part of the projectile and a powder charge, said projectile being adapted to be fired by a weapon having at least one tube with an open end and a bottom opposite to the open end, and a fire triggering device adapted for causing firing of said powder charge through a primary means, the bottom of the tube being equipped with temporary retention means cooperating with said projectile, the temporary retention means being adapted so as to cease being active as soon as the pressure developed in the bottom of the tube reaches a value $P_M$, the temporary retention means being formed by a conical force fit coupling between said male conical surface of said projectile and a female conical surface provided in the bottom of the tube having the same conicity as said male conical surface.

15. An ammunition according to claim 14, wherein the conicity of this male conical surface is between 2% and 6%.

16. An ammunition according to claim 14, wherein the axial extent of this male conical surface is between 0.5 times and 4 times the caliber of the projectile.

17. An ammunition according to claim 15, comprising a metal material lining which surrounds the projectile at least at the level of the male conical surface.

18. An ammunition according to claim 17, wherein the lining includes a front extension.

19. An ammunition according to claim 18, wherein the inner surface of the front extension includes rifling.

20. An ammunition according to claim 17, wherein the lining has, at the rear, a housing housing the priming means.

21. A weapon which is intended to fire a cooperating caseless ammunition formed of a projectile with a powder charge, said weapon comprising at least one tube with an open end and a bottom opposite to said open end, and a fire triggering device adapted for causing firing of the powder charge through a priming means, said bottom of said tube being equipped with temporary retention means cooperating with the projectile, said temporary retention means being adapted so as to cease being active as soon as the pressure developed in the bottom of the tube reaches a value $P_M$, said temporary retention means being a female conical surface provided in the bottom of the tube which cooperates with a male conical surface provided on the rear part of the projectile having the same conicity to produce a conical force fit coupling.

22. A weapon according to claim 21, comprising one or more preloaded tubes replacable after firing.

23. A weapon according to claim 22, wherein said preloaded tube or tubes are made from a plastic material.

24. A weapon according to claim 21, comprising a plurality of tubes disposed in a mobile element and a barrel, a mechanism being provided for causing the tubes of said mobile element to pass in front of the barrel.

* * * * *